US011187214B2

(12) United States Patent
Gilpatrick et al.

(10) Patent No.: US 11,187,214 B2
(45) Date of Patent: Nov. 30, 2021

(54) PUMP HAVING A UNITARY BODY

(71) Applicant: FNA Group, Inc., Pleasant Prairie, WI (US)

(72) Inventors: Richard J. Gilpatrick, Burlington, WI (US); Gus Alexander, Inverness, IL (US); Paulo Rogerio Funk Kolicheski, Gurnee, IL (US)

(73) Assignee: FNA Group, Inc., Pleasant Prairie, WI (US)

( * ) Notice: Subject to any disclaimer, the term of this patent is extended or adjusted under 35 U.S.C. 154(b) by 318 days.

(21) Appl. No.: 15/955,159

(22) Filed: Apr. 17, 2018

(65) Prior Publication Data

US 2018/0298885 A1 Oct. 18, 2018

Related U.S. Application Data

(60) Provisional application No. 62/486,146, filed on Apr. 17, 2017.

(51) Int. Cl.
*F04B 1/145* (2020.01)
*F04B 1/146* (2020.01)
(Continued)

(52) U.S. Cl.
CPC ..... *F04B 1/145* (2013.01); *F04B 1/143* (2013.01); *F04B 1/146* (2013.01); *F04B 53/18* (2013.01); *F04B 1/16* (2013.01); *F04B 19/22* (2013.01)

(58) Field of Classification Search
CPC ..... F04B 1/145; F04B 1/146; F04B 53/18; F04B 19/22; F04B 1/16; F04B 1/141;
(Continued)

(56) References Cited

U.S. PATENT DOCUMENTS 4,495,855 A * 1/1985 Murakami ..... F01B 3/02 417/269
6,053,091 A 4/2000 Tojo
(Continued)

FOREIGN PATENT DOCUMENTS

CN 103874854 A 6/2014
FR 329416 A * 7/1903 ..... F04B 1/145
(Continued)

OTHER PUBLICATIONS

Canada Office Action Issued in CA Application No. 3,001,595 dated Feb. 15, 2019.
(Continued)

*Primary Examiner* — Nathan C Zollinger
(74) *Attorney, Agent, or Firm* — Steven E. Jedlinski; Jeffrey T. Placker; Holland & Knight LLP

(57) ABSTRACT

In an embodiment, a pump includes a pump housing formed as a singular body. The pump housing may include a mounting feature adjacent a first end of the pump housing. The mounting feature may be configured for mounting the pump relative to a prime mover. A drive system cavity may be formed in the first end of the pump housing, and sized to receive at least a portion of an axial drive system. A pump cylinder may extend inwardly into the pump housing from the drive system cavity. A piston guide plate may be configured to be affixed within the drive system cavity. The piston guide plate includes a piston guide associated with the pump cylinder. The piston guide may be configured to at least partially receive a pump piston therethrough for facilitating alignment and axial movement of a pump piston within the pump cylinder.

17 Claims, 15 Drawing Sheets

(51) Int. Cl.

| | |
|---|---|
| ***F04B 53/18*** | (2006.01) |
| ***F04B 1/143*** | (2020.01) |
| ***F04B 19/22*** | (2006.01) |
| ***F04B 1/16*** | (2006.01) |

(58) Field of Classification Search

CPC .. F04B 1/143; F04B 17/00; F04B 1/14; F04B 9/04–042; F04B 17/03; F04B 17/05; F04B 53/16–162; F04B 53/22; F04B 1/122; B08B 3/024

USPC ..... 417/222.1, 269, 271, 364, 419, 539; 92/12.2, 13, 146, 147, 171.1; 29/888, 29/888.02, 888.06

See application file for complete search history.

(56) References Cited

U.S. PATENT DOCUMENTS

| | | | | |
|---|---|---|---|---|
| 6,644,277 | B2 * | 11/2003 | Blass | F04B 1/28 123/446 |
| 7,611,337 | B2 * | 11/2009 | Reverberi | F04B 1/145 417/269 |
| 8,083,497 | B2 * | 12/2011 | Gilpatrick | F04B 17/06 417/234 |
| 8,475,141 | B2 * | 7/2013 | DaRif | F04B 1/145 417/271 |
| 2010/0290927 | A1 * | 11/2010 | DaRif | F04B 1/145 417/271 |
| 2013/0216402 | A1 * | 8/2013 | Raasch | F04B 17/03 417/212 |

FOREIGN PATENT DOCUMENTS

| | | | | |
|---|---|---|---|---|
| GB | 672173 A | * | 5/1952 | F04B 1/148 |
| WO | 2009098035 | | 2/2009 | |

OTHER PUBLICATIONS

Examination Report dated Apr. 27, 2021 in Chinese Patent Application No. 201810346300.3.

* cited by examiner

PUMP HAVING A UNITARY BODY

CROSS-REFERENCE TO RELATED APPLICATION

This application claims the benefit of U.S. provisional patent application Ser. No. 62/486,146, filed on Apr. 17, 2017, entitled "Pump," the entire disclosure of which is incorporated herein by reference.

TECHNICAL FIELD

The present disclosure generally relates to pumps, and more particularly relates to pumps with a unitary pump housing casting.

BACKGROUND

Many domestic and commercial water usage applications may require relatively high pressures, which may be beyond the capacity of residential and/or municipal water distribution and supply systems. For example, heavy duty cleaning applications may benefit from increased spraying pressure that is greater than the pressure available for common residential and/or municipal water distribution and supply systems. In some situations, various nozzles may be utilized to constrict the flow of the water to provide an increase in the pressure of the resultant water stream. However, many tasks may benefit from even greater pressures than can be achieved with common pressure nozzles that may be attached to a hose. In such circumstances pressure washers may be utilized, in which a power driven pump may be employed to increase the pressure significantly above pressures that are readily achievable using hose attachments. Such elevated pressures may greatly increase the efficiency and/or effectiveness of some cleaning and spraying tasks.

SUMMARY

According to an embodiment, a pump may include a pump housing formed as a singular body. The pump housing may include a mounting feature adjacent a first end of the pump housing, the mounting feature configured for mounting the pump relative to a prime mover. The pump housing may also include a drive system cavity formed in the first end of the pump housing, the drive system cavity being sized to receive at least a portion of an axial drive system. The pump housing may further include a pump cylinder extending inwardly into the pump housing from the drive system cavity. The pump may also include a piston guide plate configured to be affixed within the drive system cavity. The piston guide plate may include a piston guide associated with the pump cylinder. The piston guide may be configured to at least partially receive a pump piston therethrough for facilitating alignment and axial movement of a pump piston within the pump cylinder.

One or more of the following features may be included. The axial drive system may at least partially seal the drive system cavity of the pump housing opposite the piston guide plate to provide an integrated oil reservoir between the axial drive system and the piston guide plate. The axial drive system may include a cam plate configured for axially driving the pump piston when the cam plate is rotational driven. The cam plate may be at least partially disposed in the integrated oil reservoir. The piston guide plate may be configured to be affixed to the pump housing by one or more bolts. A head of each of the one or more bolts may be at least partially disposed within the integrated oil reservoir.

The piston guide may include a bore extending through the piston guide plate, and having a seal associated with the bore to mitigate fluid intrusion between the pump piston and the piston guide plate. A seal may be disposed between at least a portion of the piston guide plate and the pump housing. The seal may include an O-ring disposed in a groove around a periphery of the piston guide plate.

The pump may further include one or more fluid passages formed between the pump housing and the piston guide plate. The one or more fluid passages may provide a fluid pathway between the piston guide and a fluid intake of the pump cylinder. The fluid passage may include a channel formed on a surface of the piston guide plate. The channel may be configured to be substantially enclosed by the pump housing when the piston guide plate is assembled with the pump housing.

The pump housing includes an at least partially integrally formed low pressure intake manifold associated with the pump cylinder. The pump housing include an at least partially integrally formed high pressure outlet manifold associated with the pump cylinder.

According to another implementation, a pump may include a pump housing formed as a singular body. The pump housing may include a mounting feature adjacent a first end of the pump housing, the mounting feature configured for mounting the pump relative to a prime mover. The pump housing may also include a drive system cavity formed in the first end of the pump housing. The drive system cavity may be sized to receive at least a portion of an axial drive system. The pump housing may also include a plurality of pump cylinders extending inwardly into the pump housing from the drive system cavity. The pump may also include a plurality of pump pistons. A respective one of the plurality of pump pistons may be reciprocatingly received in a respective one of the plurality of pump cylinders. The pump may further include a piston guide plate configured to be affixed within the drive system cavity. The piston guide plate may include a respective piston guide associated with each of the plurality of pump cylinders. Each piston guide may be configured to at least partially receive a respective pump piston therethrough for facilitating alignment and axial movement of the respective pump piston within the respective pump cylinder.

One or more of the following features may be included. The axial drive system may at least partially seal the drive system cavity of the pump housing opposite the piston guide plate to provide an integrated oil reservoir between the axial drive system and the piston guide plate. The piston guide plate may be configured to be affixed to the pump housing by one or more bolts. A head of each of the one or more bolts may be at least partially disposed within the integrated oil reservoir. A seal may be disposed between the pump housing and the piston guide plate at least partially surrounding each of the one or more bolts.

The piston guide plate may include one or more channels formed on a surface of the piston guide plate. The one or more fluid passages may at least partially surround each respective piston guide, and provide a fluid pathway between each respective piston guide and one or more of a fluid intake of the pump and a drain. The one or more channels may be at least partially enclosed by the pump housing when the piston guide plate is assembled with the pump housing.

The pump housing may include an at least partially integrally formed low pressure intake manifold associated with the plurality of pump cylinders. The pump housing may include an at least partially integrally formed high pressure outlet manifold associated with the plurality of pump cylinders.

According to yet another implementation, a pump may include a pump housing formed as a singular body. The pump housing may include a mounting feature adjacent a first end of the pump housing, the mounting feature configured for mounting the pump relative to a prime mover. The pump housing may also include a drive system cavity formed in the first end of the pump housing. A plurality of pump cylinders may extend inwardly into the pump housing from the drive system cavity. The pump housing may include an at least partially integrally formed low pressure intake manifold associated with the plurality of pump cylinders. The pump housing may further include an at least partially integrally formed high pressure outlet manifold associated with the plurality of pump cylinders. The pump may also include a plurality of pump pistons. A respective one of the plurality of pump pistons may be reciprocatingly received in a respective one of the plurality of pump cylinders. The pump may also include a piston guide plate configured to be affixed within the drive system cavity and sealingly engaged with the pump housing. The piston guide plate may include a respective piston guide associated with each of the plurality of pump cylinders. Each piston guide may be configured to at least partially receive a respective pump piston therethrough for facilitating alignment and axial movement of the respective pump piston within the respective pump cylinder. The pump may further include an axial drive system at least partially disposed within the drive system cavity. The axial drive system may, at least in part, provide an integral oil reservoir within the drive system cavity between the axial drive system and the piston guide plate.

DESCRIPTION OF EXAMPLE EMBODIMENTS

According to an embodiment, the present disclosure may generally relate to a positive displacement pump including a singular, or unitary, housing casting. In some embodiments, the positive displacement pump may be utilized in a pressure washer system. Generally, the pressure washer system may receive an input flow of water, for example, from a domestic or municipal water supply or the like, and may utilize a pump to provide an output flow of the water having a greater pressure than the input flow. It will be appreciated that while the present disclosure may generally be described in the context of pumping water for use with a pressure washer system, a pump consistent with the present disclosure may suitable be used an a variety of applications for pumping a wide variety of fluids and in a wide variety of applications.

Figure 1:
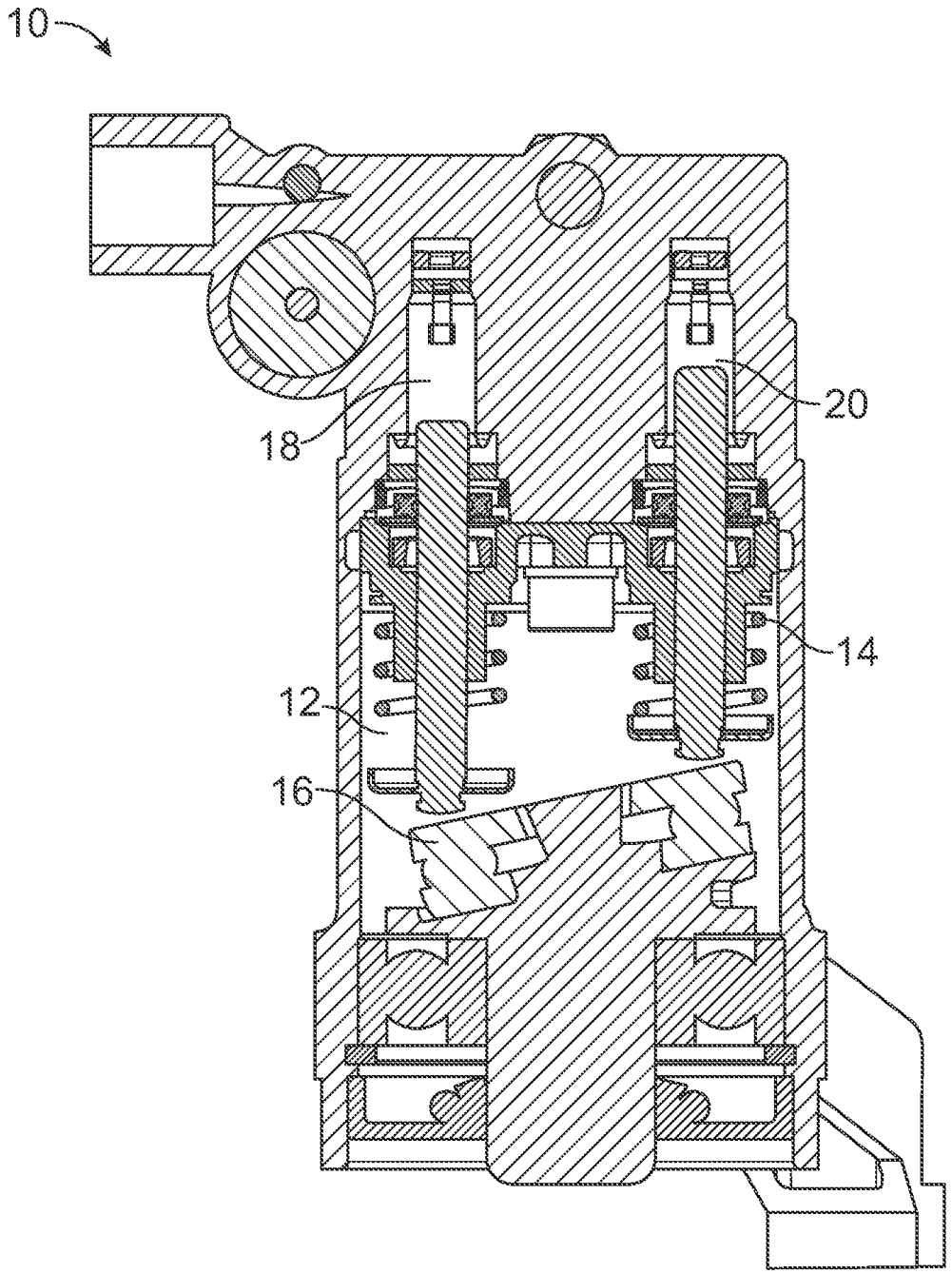
FIG. 1 is a cross-sectional view of a pump according to an illustrative example embodiment.

In general, the positive displacement pump 10 may include one or more axial piston pumps arranged in the common singular housing casting. The one or more axial piston pumps may be driven by a rotating cam plate, e.g., which may be rotatably driven by a prime mover such as a gas engine or electric motor. In various embodiments, the rotating cam plate may include a fixed angle cam plate (e.g., which may provide a fixed piston pump travel and fixed pump output per rotation of the cam plate) or a variable angle cam plate/swashplate (e.g., which may be capable of providing varying piston pump travel and varying pump output per rotation). Each of the individual piston pumps may be spring driven, e.g., to an intake position (e.g., defining an intake volume within the pump cylinder), and may be driven by the cam plate to the pumped position (e.g., by which fluid drawn into the cylinder may be expelled), e.g., as generally shown in the cross-sectional view of FIG. 1, in which the depicted piston pump 12 is generally in the intake position and the depicted piston pump 14 is generally in the pumped position, being driven by the cam plate 16. It will be appreciated that, while in the cross-sectional views of FIGS. 1 and 2 only two piston pumps are shown, a greater or fewer number of piston pumps may be utilized. Additionally, while the depicted embodiment employs a spring for biasing the piston pumps toward the intake position and a cam plate for driving the piston pumps toward the pumped position, other configurations may equally be utilized.

Consistent with the foregoing, in an illustrative example embodiment, a pump may include a pump housing formed as a singular body. The pump housing may include a mounting feature adjacent a first end of the pump housing, the mounting feature configured for mounting the pump relative to a prime mover. The pump housing may also include a drive system cavity formed in the first end of the pump housing, the drive system cavity being sized to receive at least a portion of an axial drive system. The pump housing may further include a pump cylinder extending inwardly into the pump housing from the drive system cavity.

With further reference to FIGS. 3-11 various views of the positive displacement pump 10 having a singular housing are depicted. As generally shown, the pump housing may include a singular body, e.g., which may be cast or molded from any suitable material, such as steel, aluminum, fiber reinforced or non-reinforced polymer, or the like. Generally, the singular pump casting (e.g., unitary housing) may include integrally molded pump cylinders 18, 20 (shown in the cross-sectional views of FIGS. 1 and 2). Additionally, the singular pump casting may also include mounting members 22, 24, 26, e.g., which may allow the pump 10 to be mounted relative to a prime mover (e.g., by either being directly mounted to the prime mover, mounted to a frame, or mounted to a common intermediary structure, including in various horizontal and/or vertical configurations). It will be appreciated that while the illustrated embodiment is shown including a three leg flange, such as a SAE J609D flange (e.g., including mounting members 22, 24, 26), the housing may be formed utilizing other mounting arrangements. Examples of such additional and/or alternative mounting arrangements may include, but are not limited to, a C-face electric motor flange, a SAE J609A or B horizontal flange, and a SAE J609D hoop motor flange (e.g., which may be reversible). Other suitable mounting arrangements may equally be utilized to suit various applications.

Figure 2:
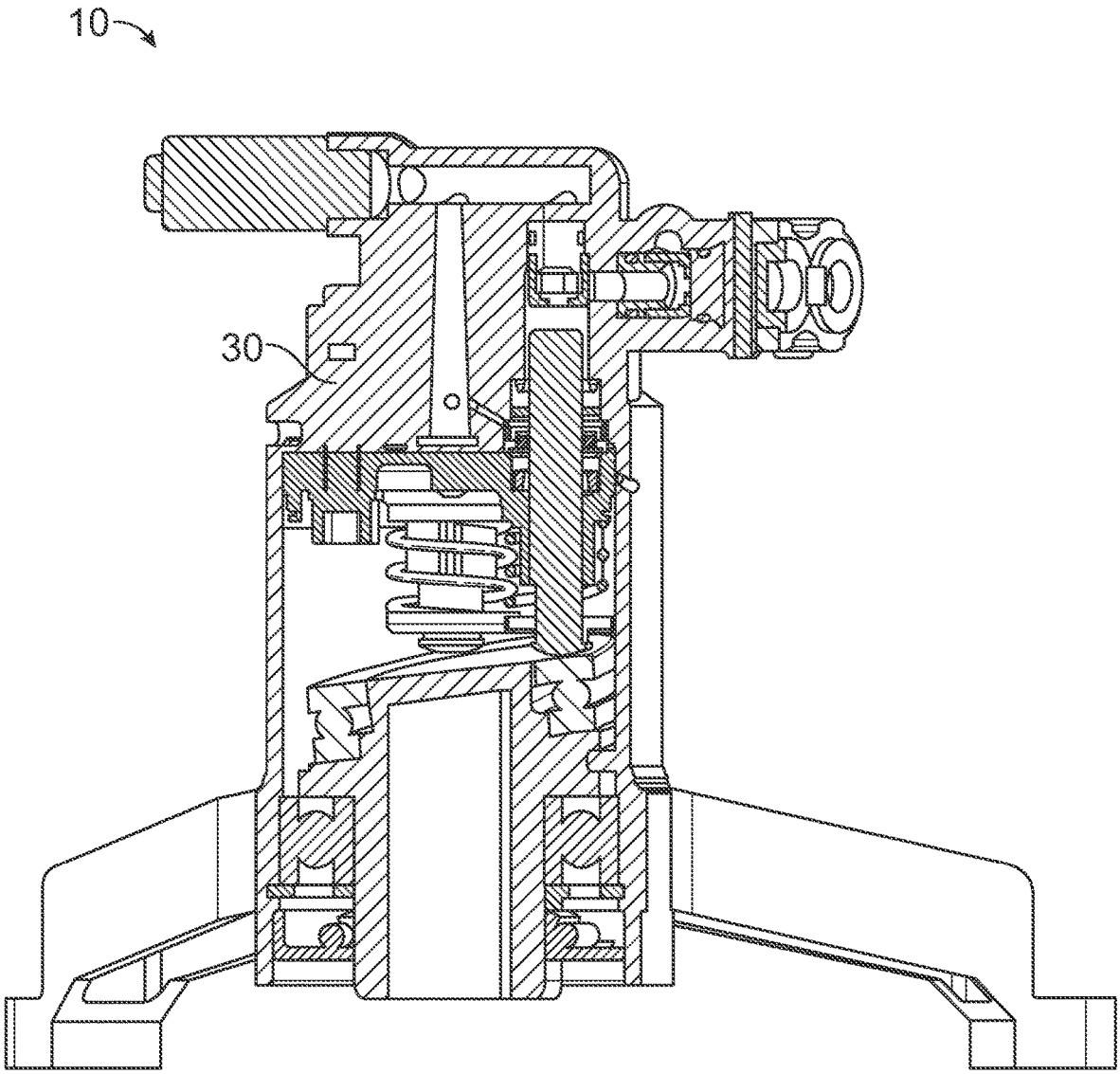
FIG. 2 is a further cross-sectional view of the pump according to the illustrative example embodiment.
Figure 3:
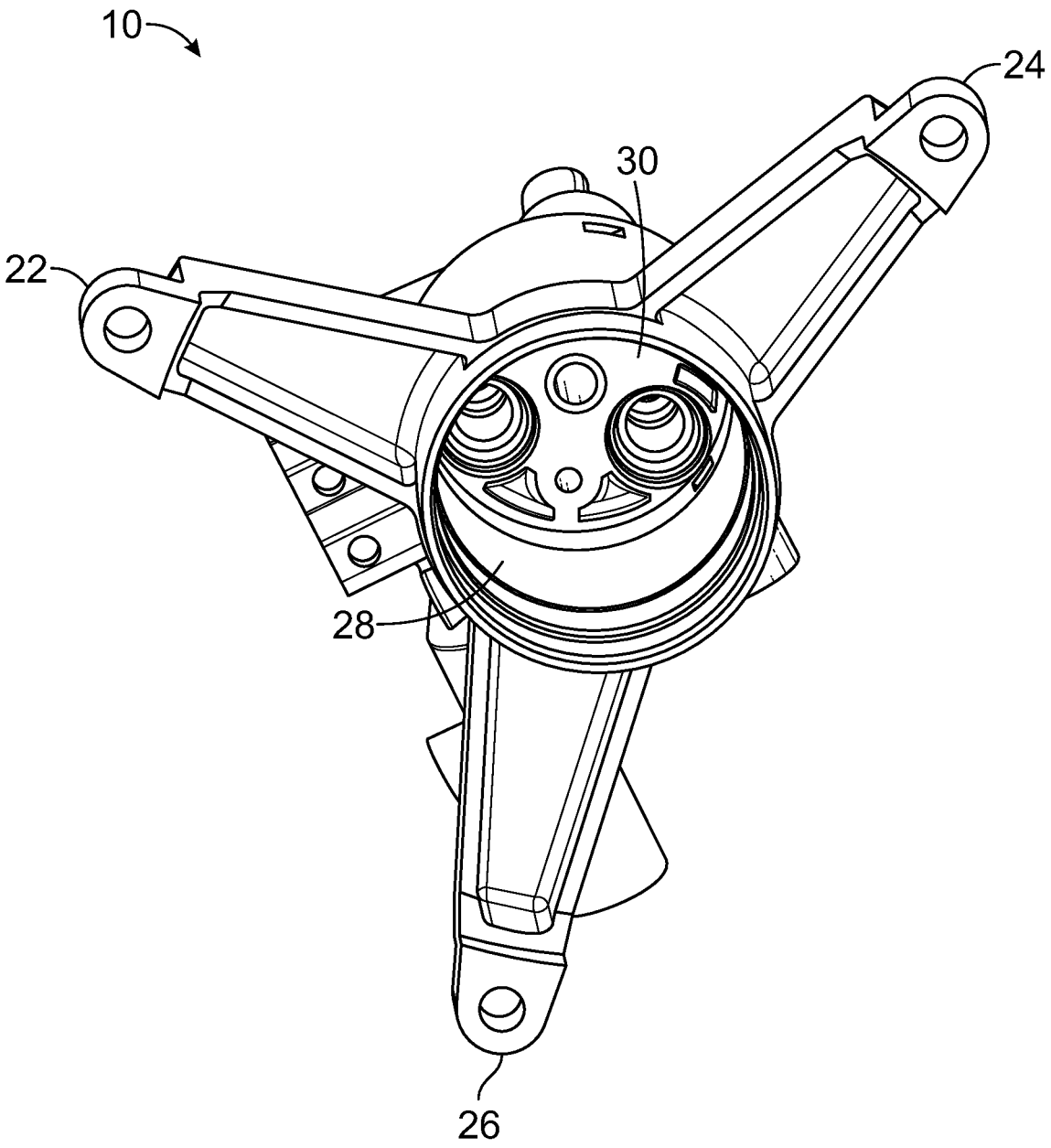
FIG. 3 is a perspective view of a pump housing according to the illustrative example embodiment.
Figure 4:
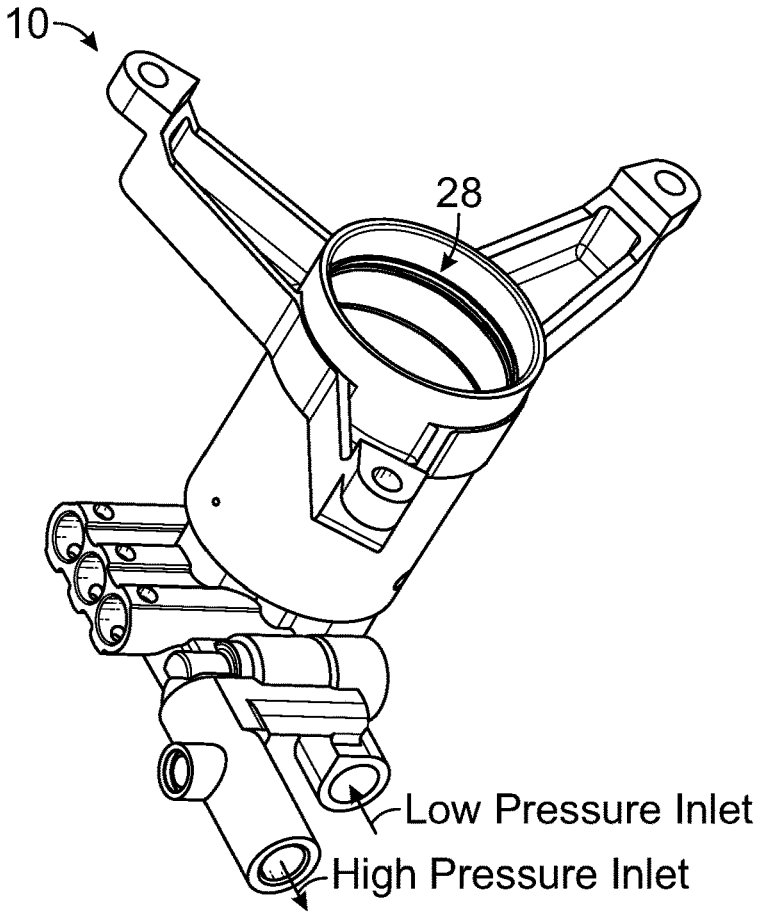
FIG. 4 is a further perspective view of the pump housing according to the illustrative example embodiment.
Figure 5:
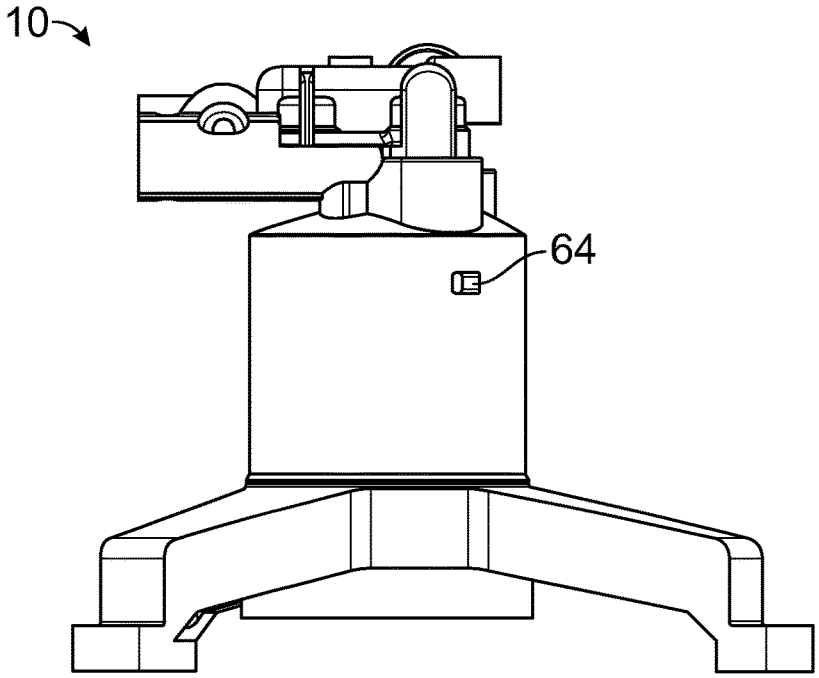
FIG. 5 is a side view of the pump housing according to the illustrative example embodiment.
Figure 6:
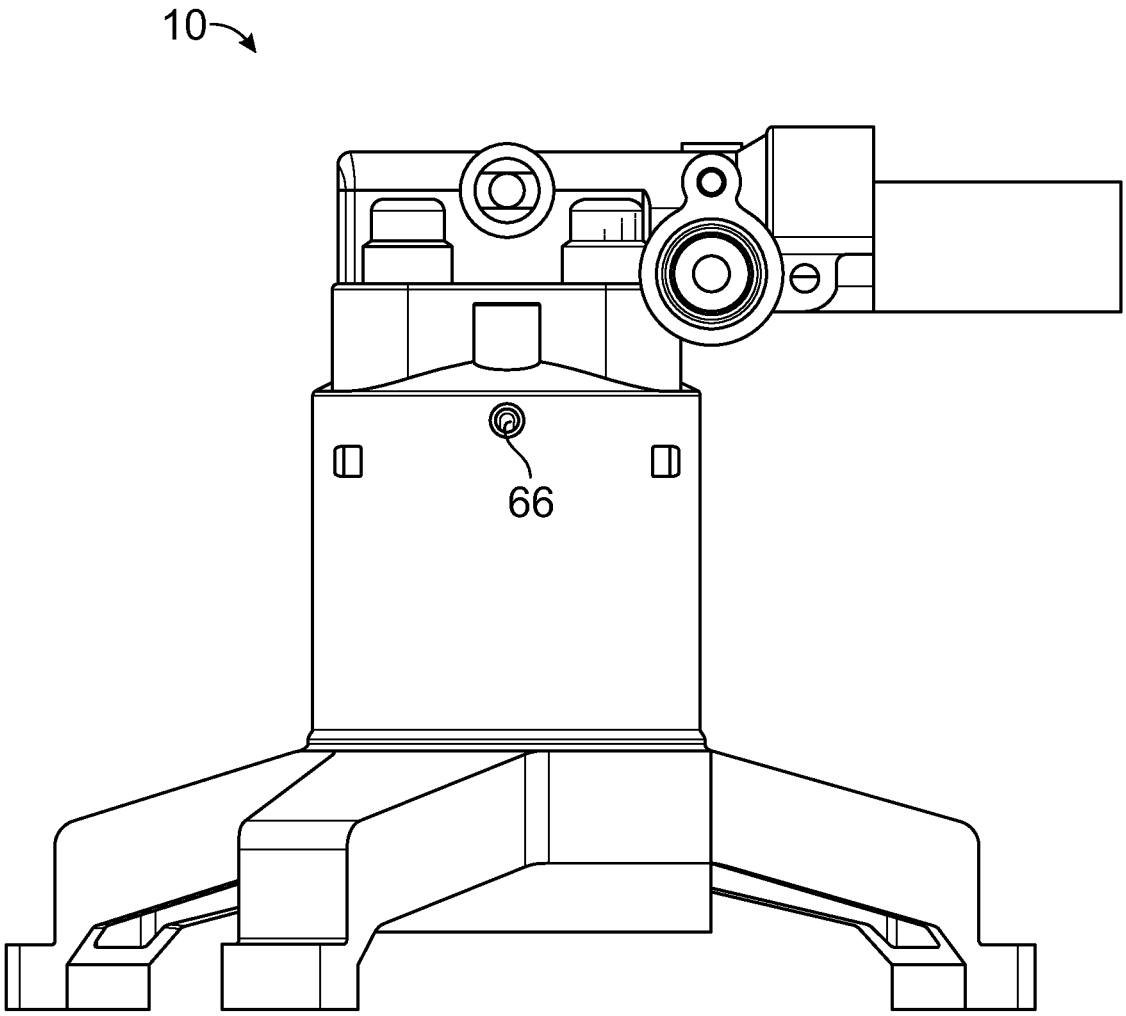
FIG. 6 is a side view of the pump housing according to the illustrative example embodiment.
Figure 7:
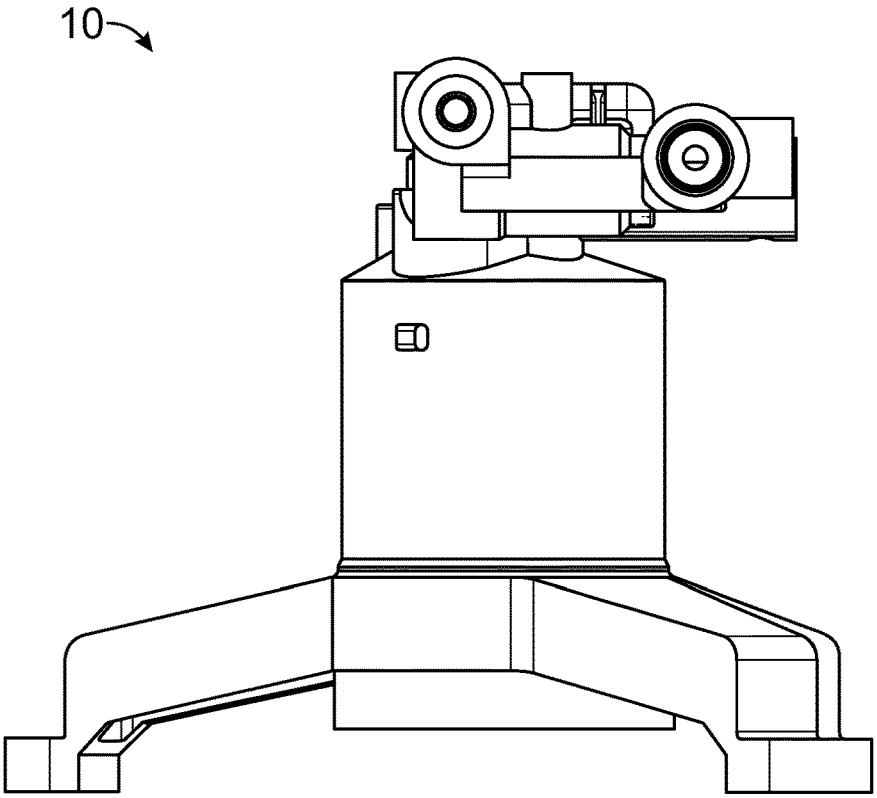
FIG. 7 is a front view of the variable pump housing according to the illustrative example embodiment.
Figure 8:
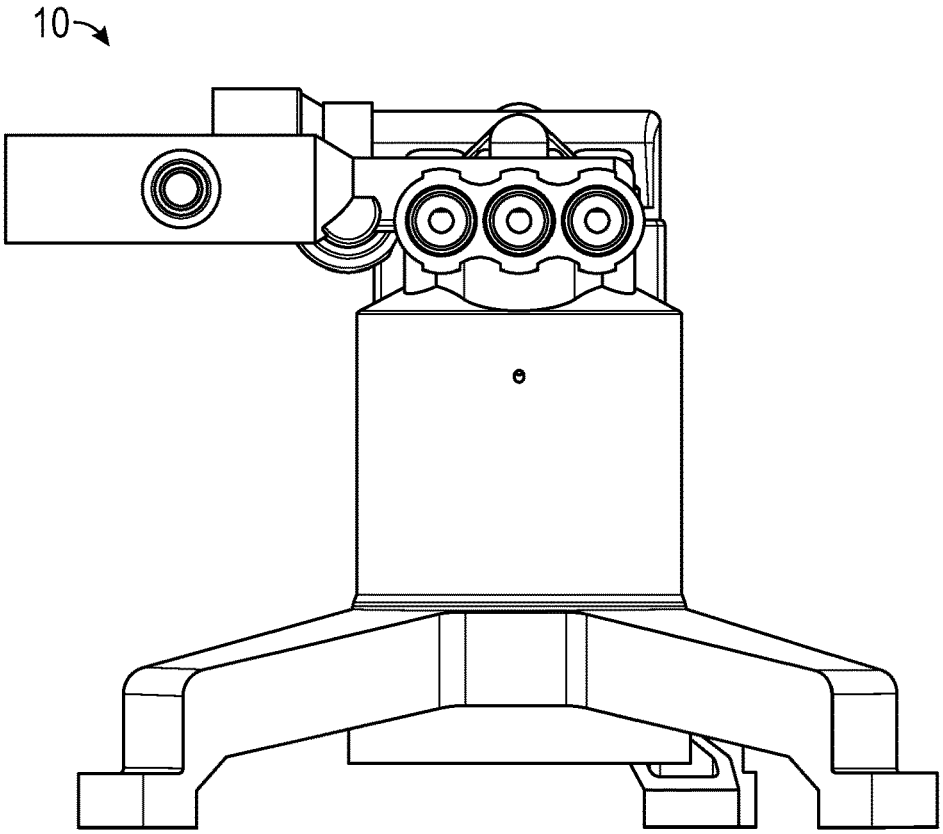
FIG. 8 is a rear view of the pump housing according to the illustrative example embodiment.
Figure 9:
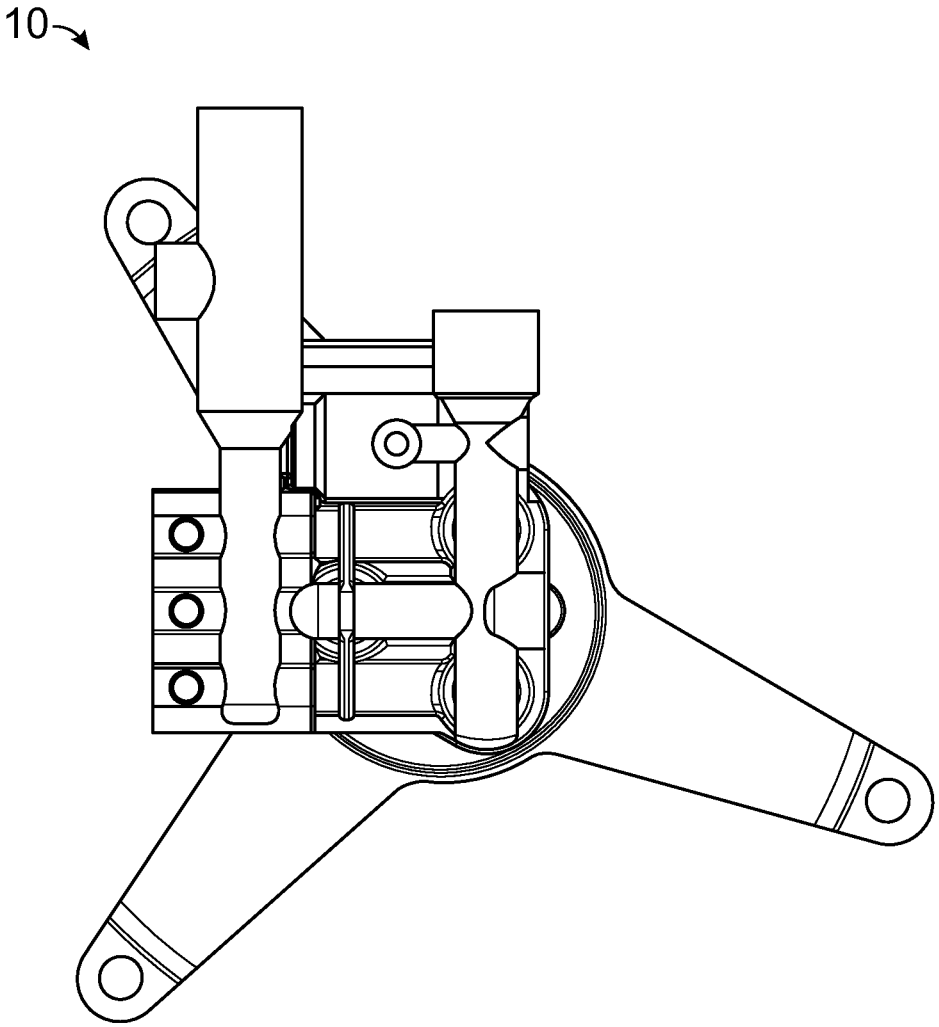
FIG. 9 is a top view of the pump housing according to the illustrative example embodiment.
Figure 10:
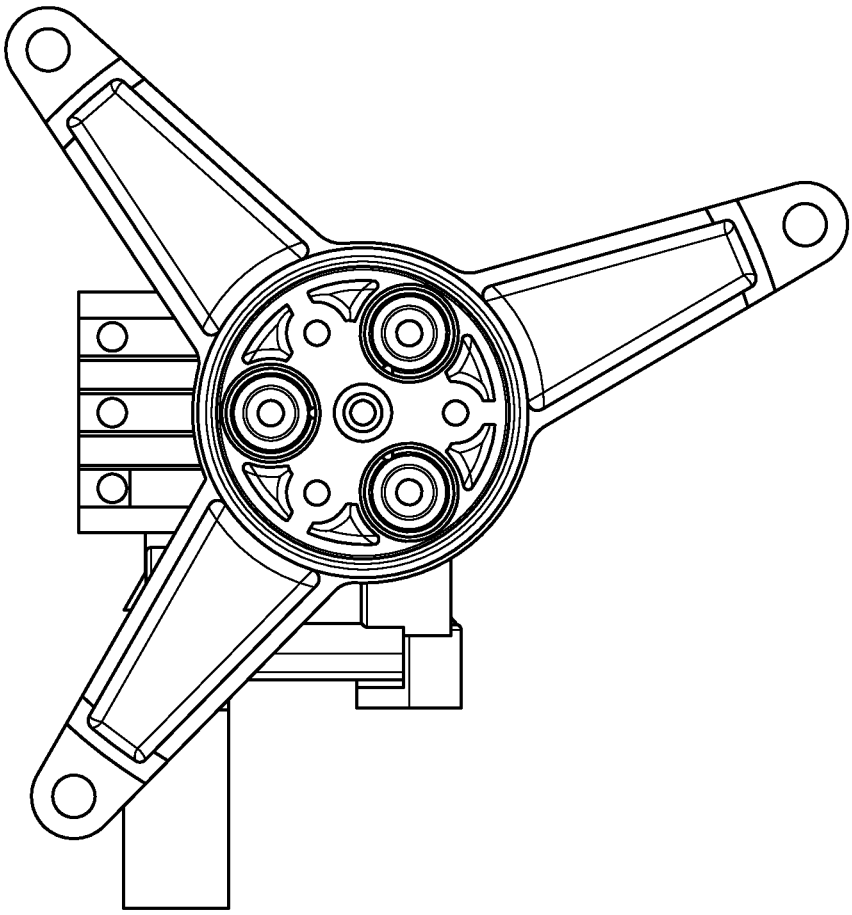
FIG. 10 is a bottom view of the pump housing according to the illustrative example embodiment.
Figure 11:
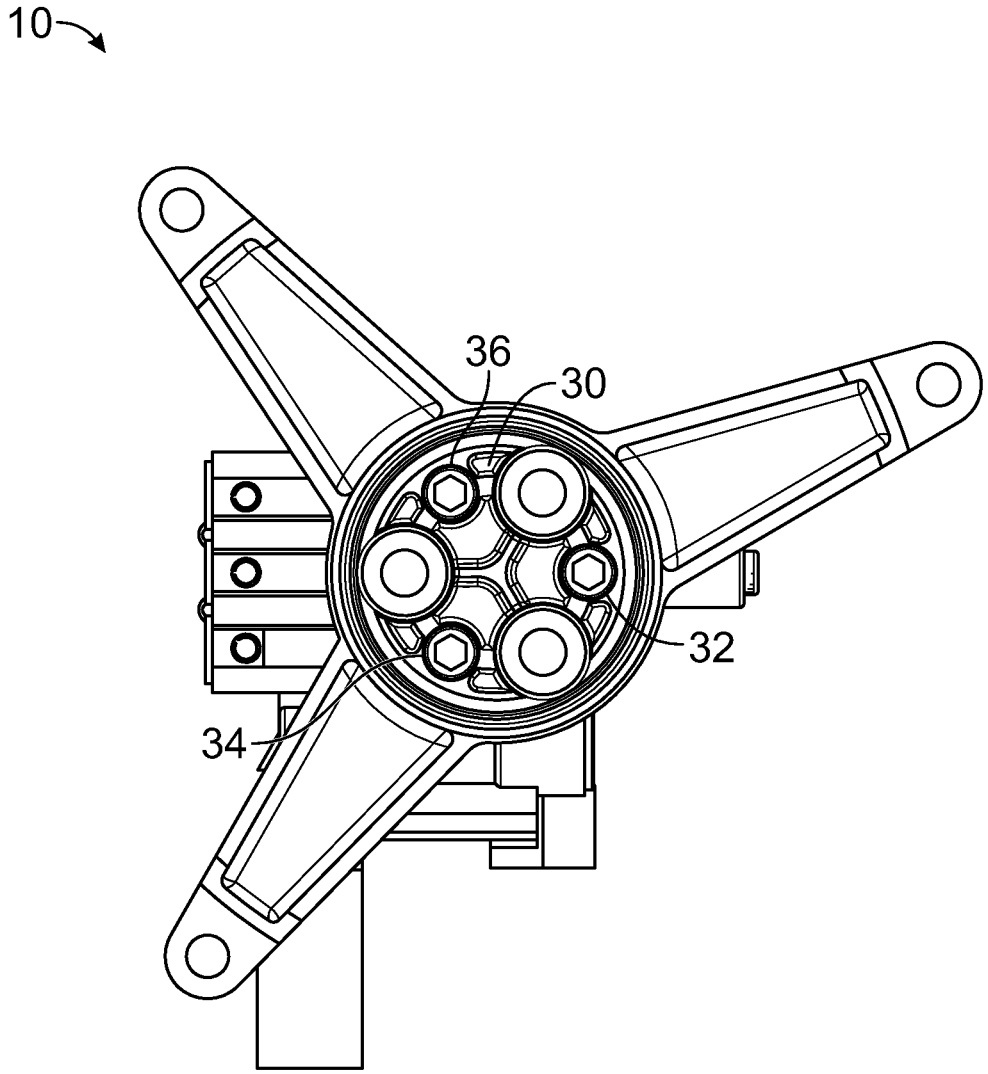
FIG. 11 is a bottom view of the pump housing including an installed piston guide plate according to the illustrative example embodiment.
Figure 12:
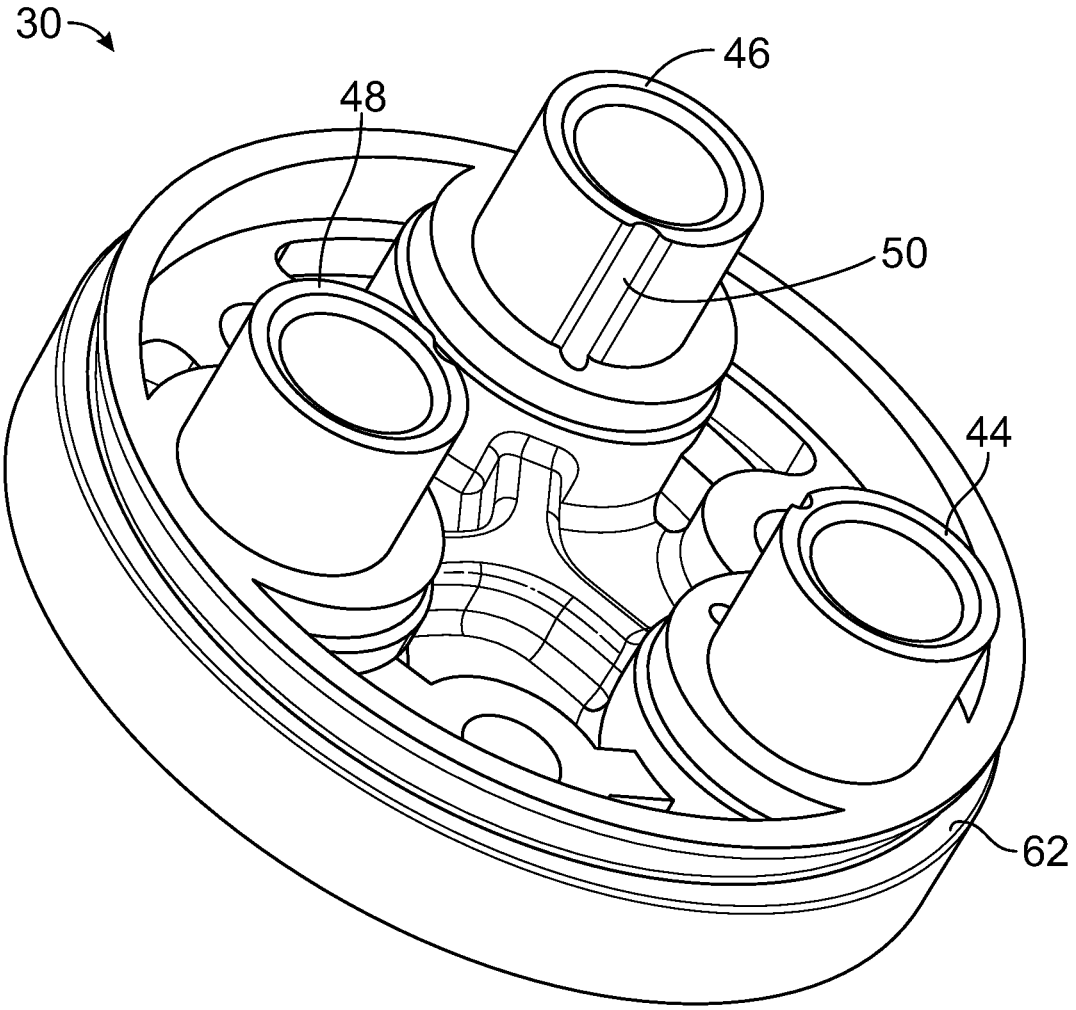
FIG. 12 is a bottom perspective view of the piston guide plate according to the illustrative example embodiment.
Figure 13:
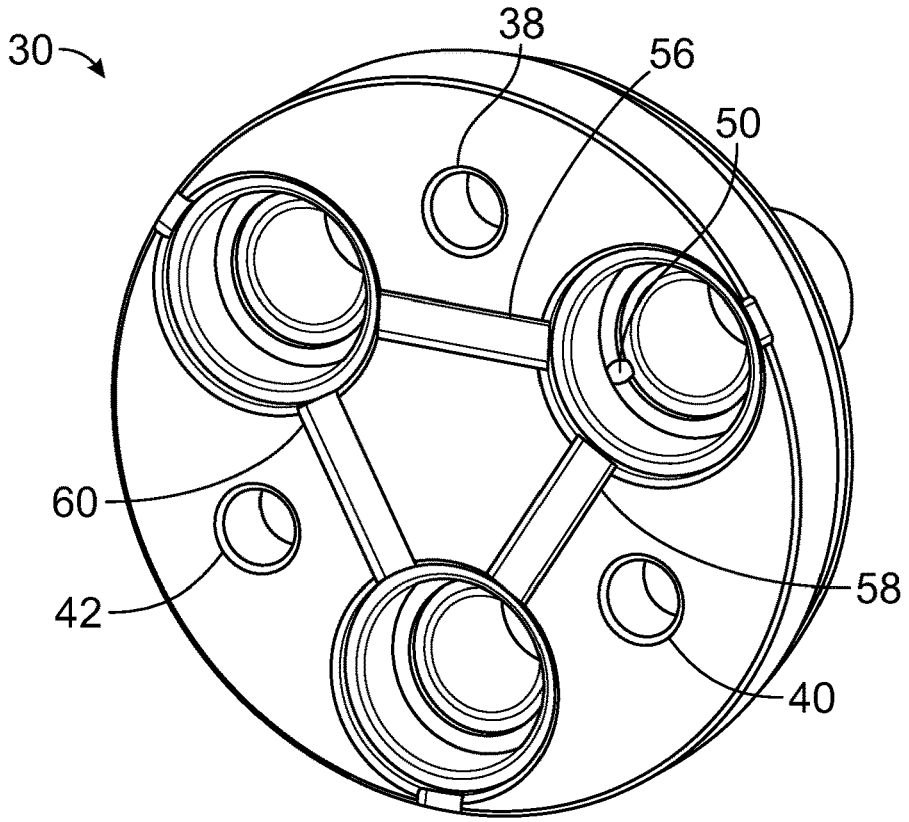
FIG. 13 is a top perspective view of the piston guide plate according to the illustrative example embodiment.
Figure 14:
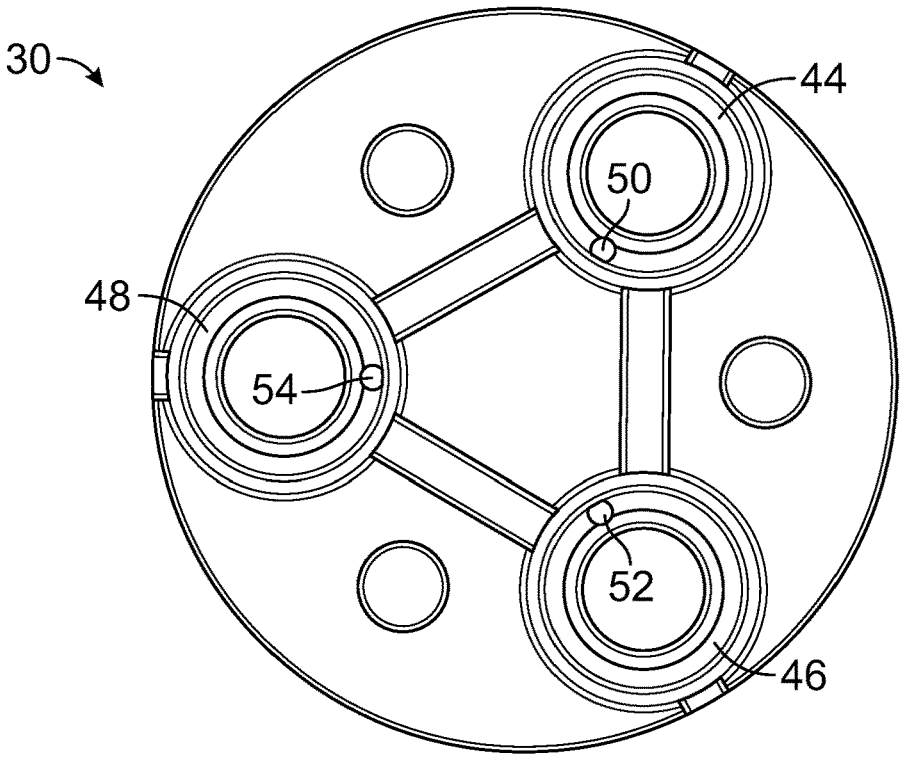
FIG. 14 is a top view of the piston guide plate according to the illustrative example embodiment.
Figure 15:
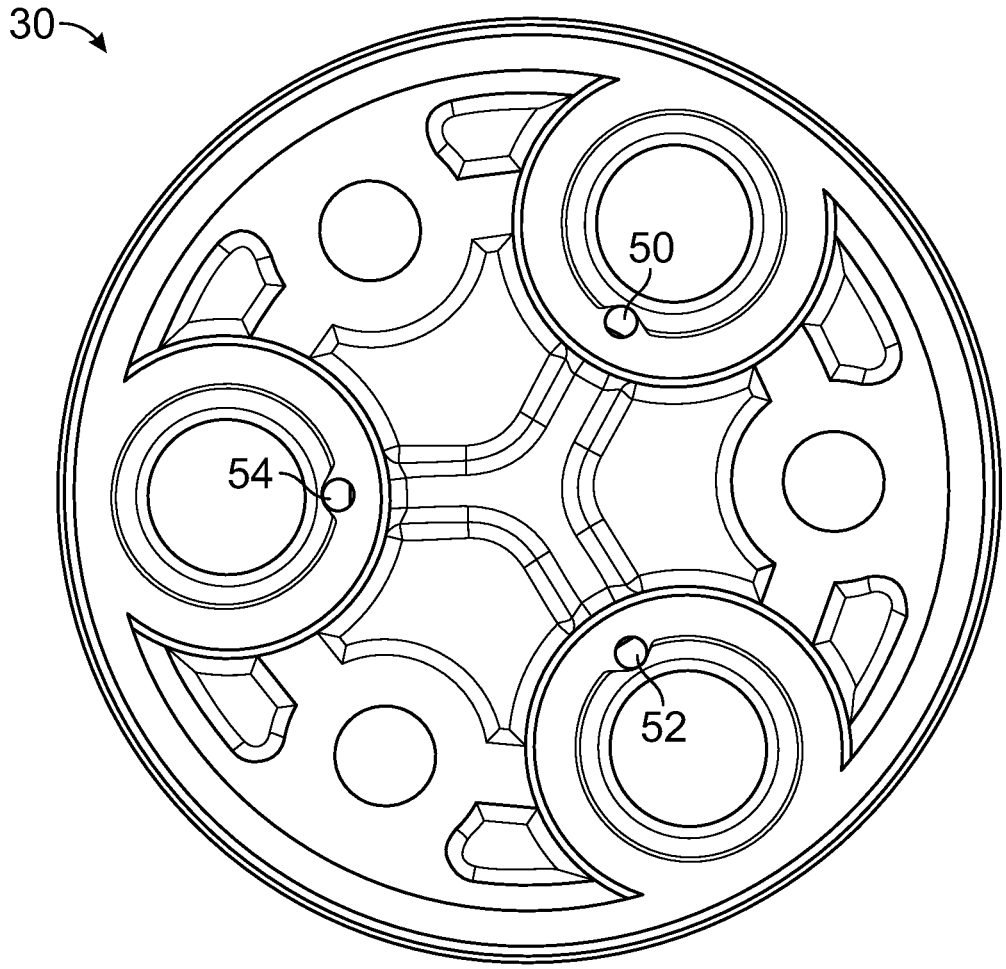
FIG. 15 is a bottom view of the piston guide plate according to the illustrative example embodiment.
Figure 16:
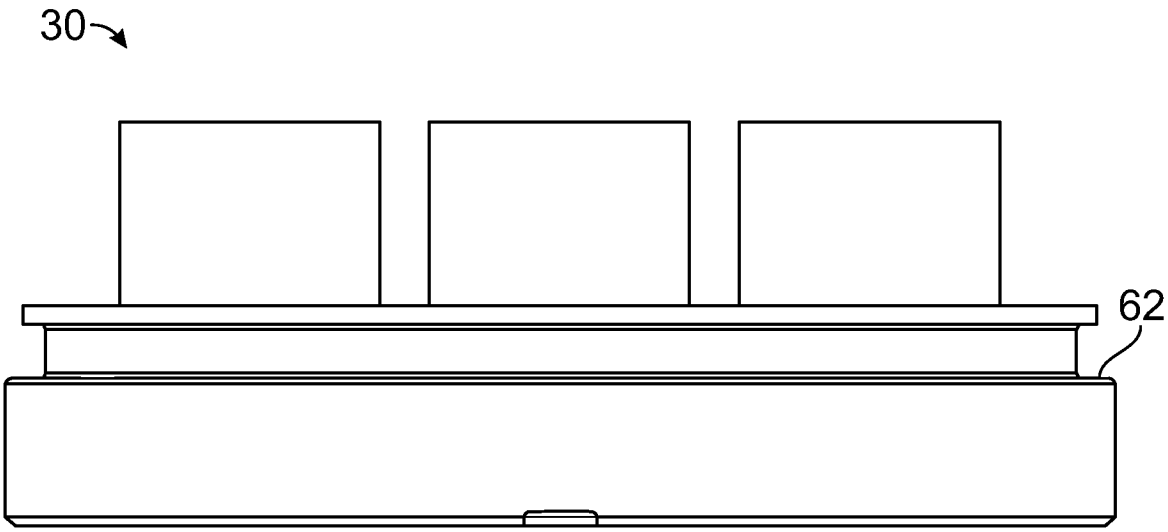
FIG. 16 is a side view of the piston guide plate according to the illustrative example embodiment.

Further, the singular casting may define an axial drive system cavity 28 (e.g., as shown in FIGS. 3 and 4). In an embodiment, the axial drive system cavity 28 may generally receive the cam plate 16 as well as bearings and seals associated with the axial drive system. Further, the axial drive system cavity 28 may define, in conjunction with the axial drive assembly (e.g., the cam plate 16 and associated bearings and seals) and with a piston guide plate 30 (e.g., as shown in FIGS. 2, 3, and 11), an integrated oil reservoir. In one such configuration, the axial drive system may generally provide a fluid seal relative to the bottom of the singular casting (e.g., to prevent and/or minimize oil leakage therefrom), and the piston guide plate 30 may generally provide a fluid seal at the top of the axial drive system cavity 28 (e.g., to prevent and/or minimize oil leakage therefrom).

In an implementation, the integral oil reservoir may, at least in part, provide lubrication for the reciprocating movement of the axial pistons and/or for the driving interaction between the cam plate and the axial pistons. As such, wear associated with the axial pistons and/or the cam plate may be reduced as a result of the provided lubrication. As shown in FIG. 11, in an embodiment, the piston guide plate may be affixed within the axial drive system cavity by one or more fasteners (e.g., bolts 32, 34, 36). In an embodiment the fasteners may be at least partially received in bores that are molded into the singular casting. In some such embodiments, the heads of the fasteners may be sealingly engaged with the piston guide plate using ductile metal washers, or other suitable sealing features, to prevent and/or reduce the leakage of oil or water through the fastener holes in the piston guide plate. Similarly, in some embodiments, ductile metal washers, or other suitable sealing features, may be disposed between the piston guide plate and the fastener bores molded into the singular casting around the fastener holes in the piston guide plate. Consistent with such a configuration, the exposed heads of the fasteners may be disposed within the integral oil reservoir. By being disposed within the integral oil reservoir, the oil within the oil reservoir may prevent and/or reduce corrosion of the fasteners and/or fastener heads. In some specific embodiments, high strength bolts may be used for affixing the piston guide plate within the axial drive system cavity. In some situations, as at least the head of the bolts may be disposed within the integral oil reservoir it may not be necessary to provide surface treatment of the bolts (and or may be possible to use lower cost surface treatment options) to provide corrosion prevention. Accordingly, the cost of the bolts may be reduced (e.g., by eliminating the need for surface treatment and/or allowing lower cost surface treatments), and may reduce, or eliminate, the occurrence of hydrogen embrittlement which may sometimes occur due to environmental conditions and/or defects in surface treatments and/or surface treatment processes. It will be appreciated that in some implementations, an integral oil reservoir may not be utilized. In some such situations, the bearings associated with the axial drive system and the pistons may include self-lubricating bearings (e.g., sealed bearings, bearings formed from a low friction material, etc.).

With particular reference to FIGS. 12-16, an illustrative example embodiment of the piston guide plate 30 is shown. As generally discussed, the piston guide plate 30 may include a separate component from the unitary housing, and may be affixed within the housing, e.g., via one or more fasteners which may extend to holes 38, 40, 42 formed in the piston guide plate 30. Additionally, the piston guide plate 30 may include a piston guide for each respective pump piston (e.g., piston guides 44, 46, 48 in the illustrative example in which the pump includes three axial piston pumps). The individual pump pistons may be at least partially received through the respective bores of the piston guides, with the piston guides assisting in the alignment and axial movement of the pump pistons in response to the rotational driving movement of the cam plate. It will be appreciated that while the piston guides 44, 46, 48 have been shown as being generally symmetrically arranged on the piston guide plate 30, in other implementations the piston guides may be arranged in a non-symmetrical configuration. Similarly, it will also be appreciated that while the holes 38, 40, 42 have been shown as being generally symmetrically arranged on the piston guide plate 30, in other implementations the holes may be arranged in a non-symmetrical configuration. In some implementations in which the piston guides and/or the hole are arranged in a non-symmetrical configuration the piston guide plate may include one or more clocking features, which may cooperate with corresponding features on the housing to facilitate alignment of the piston guide plate within the housing.

It will be appreciated that various O-rings and/or other sealing arrangements may be included between the pump pistons and the piston guides, e.g., to prevent and/or reduce the occurrence or amount of oil from the integral oil reservoir passing into the pump cylinders. Similarly, the various O-rings and/or other sealing arrangements may prevent and/or reduce the occurrence or amount of water from the pump cylinders passing through the piston guide plate into the integral oil reservoir. It will be appreciated that various sealing arrangements may include multiple seals in combination with one another. In embodiments utilizing multiple seals in combination with one another, the multiple seals may be of the same type and/or may include different types of seals and/or sealing arrangements. In some implementations, oil drain holes (e.g., oil drain holes 50, 52, 54) may be provided in the piston guides. The oil drain holes may, for example, allow oil, which may intrude between the piston guide bores and the pump pistons, to drain back to the integral oil reservoir. For example, the reciprocating movement of the pump pistons may draw oil from the integral oil reservoir between the pump pistons and the bores of the piston guides. The migration of the oil through the piston guide plate may be prevented and/or reduced by the O-rings or other sealing arrangements at the top of the piston guide plate. The oil drain holes may be disposed below the seal, for example at the bottom of a cavity or counterbore in the piston guide that at least partially receives the O-ring or other sealing feature. As such, oil may be scraped from the pump piston by the O-ring or other sealing feature and returned to the integral oil reservoir via the oil drain holes. As shown in the illustrated example embodiment, in some implementations a lower portion of the oil drain holes may manifest as a groove in the exterior of the piston guides. However, other configurations may be utilized.

In some embodiments, the piston guide plate may also include one or more water control passages (e.g., water control passages 56, 58, 60) may be formed in the piston guide plate. The water control passages may include molded in features of the piston guide plate or may include machined channels in the piston guide plate. In some embodiments, when the piston guide plate is assembled with the pump housing, the water control passages may form enclosed channels. As shown the water control passages may generally extend between, and in some embodiments surround, the bore of each piston guide. In some such situations, any water that may leak around the pump piston during pumping may flow into the water control passages. According to various embodiments, water flowing into the water control passages may be directed back into a low pressure water inlet, directed to a drain, or otherwise controlled. For example, in some embodiments, the pump housing may include one or more channels or passages that fluidly couple the water control passages with the low pressure water inlet. In some embodiments, as shown in the depicted example, the water control passages may extend to the outer perimeter of the piston guide plate.

In embodiments in which the piston guide plate may prevent and/or reduce the passage of oil from the integral oil reservoir and/or provide water control passages to prevent or control the escape of water leaking past the pump pistons, the piston guide plate may be at least partially sealed relative to the pump housing. For example, an O-ring or other seal may be provided between the piston guide plate and the housing. As shown in the illustrated example embodiment, the piston guide plate may include a groove or channel (e.g., groove 62) that may be configured to include an O-ring or other seal, which may engage the wall of the axial drive system cavity to provide a generally fluid tight seal between the piston guide plate and the housing. While the illustrated embodiment generally depicts an O-ring disposed within a groove in the side of the piston guide plate, it will be appreciated that other sealing arrangements may be implemented, including sealing arrangements that make use of multiple seals (e.g., which may be of the same type of seal/sealing arrangement, and/or may include different types of seals/sealing arrangements). For example, in some embodiments a seal, such as an O-ring or gasket, may be disposed between the top of the piston guide plate and an inner surface of the housing (e.g., a surface within the cavity 28).

In some implementations, the singular pump casting may include an integrated low pressure water inlet manifold and/or an integrated high pressure outlet, as generally shown in FIG. 4. One or both of the low pressure water inlet and the high pressure outlet manifolds may be integrally molded and/or may be subsequently machined into the singular pump casting. It will be appreciated that even in embodiments in which one or both of the low pressure water inlet and the high pressure water outlet may be at least partially molded into the singular pump casting, additional machining operations may be performed, e.g., to complete the manifolds and/or to provide features for housing and/or retaining one or more flow control devices, such as check valves, thermal relief valves, and the like. Further, and as shown, e.g., in FIGS. 5 and 6, the singular pump housing casting may include one or more fluid drains. For example, the pump housing may include an oil drain 64, which may, for example, allow filling and/or draining of the integral oil reservoir. Similarly, the pump housing may include a water drain 66, which may, for example, allow draining water from the water control passages, one or more of the pump cylinders, and/or one or more of the inlet or outlet manifolds. In some embodiments, one, or both, of the oil drain and the water drain may be at least partially molded into the pump housing. In other embodiments, at least a portion of the oil drain and/or the water drain may be drilled or machined into the pump housing. Further, in some implementations, one or more of the oil drain and the water drain may further provide access to the interior of the housing to allow drain-back passages to be drilled from the water inlet to the manifold.

Figure 17:
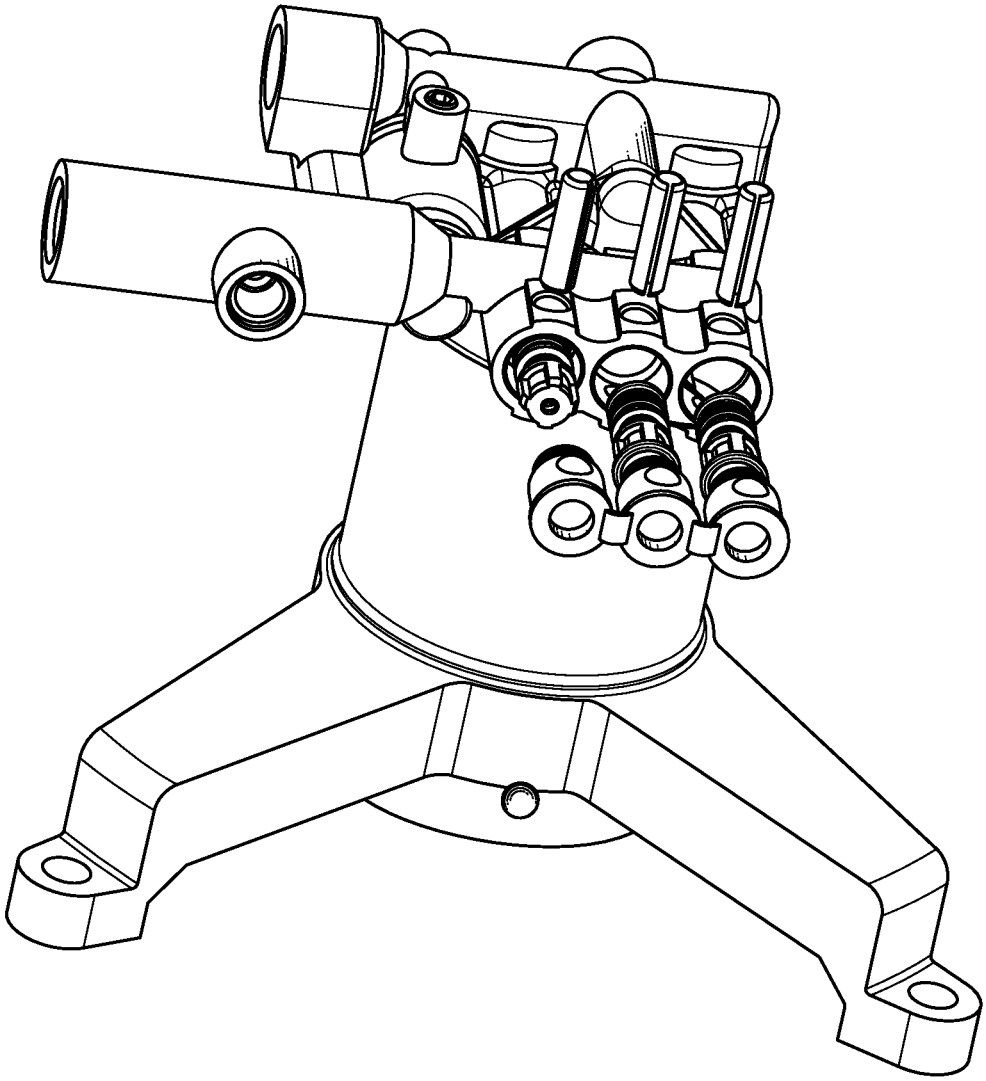
FIG. 17 diagrammatically depicts the pump with an exploded view of an outlet check valve assembly according to the illustrative example embodiment.
Figure 18A:
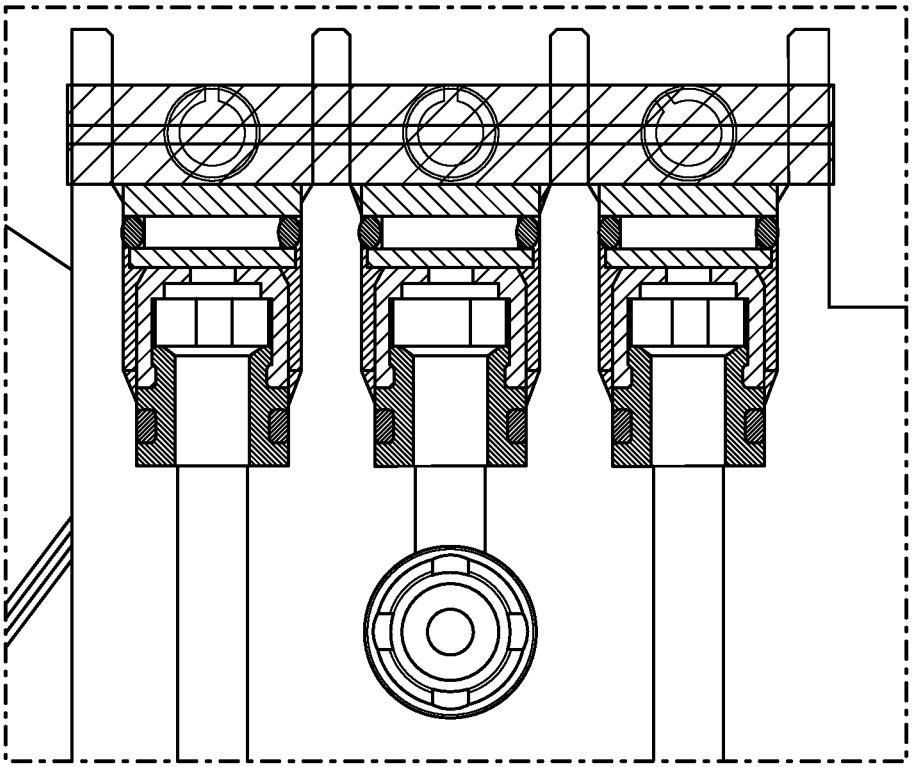
FIGS. 18A-18B diagrammatically depict features of the outlet check valve assemblies according to illustrative example embodiments.
Figure 18B:
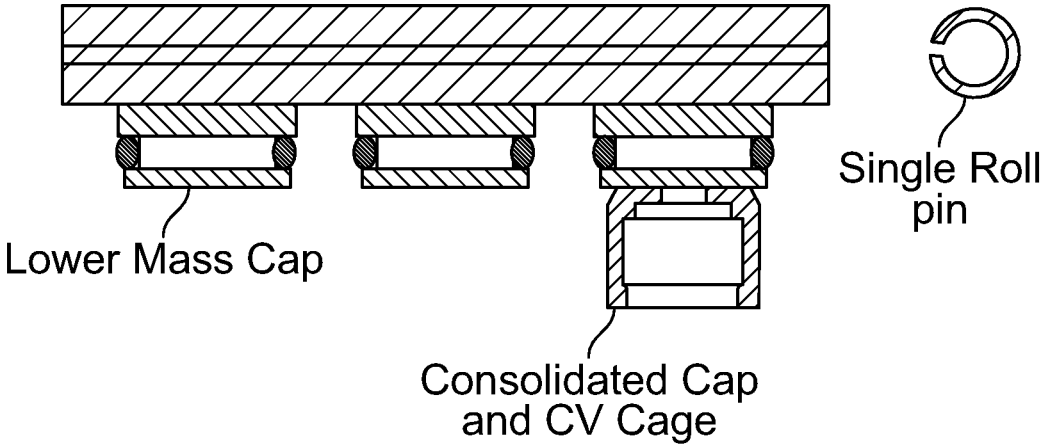

With reference also to FIGS. 17 and 18A-18B, an illustrative example of an outlet check valve assembly consistent with the present disclosure is generally shown. The outlet check valve assembly may generally include a valve body associated with each of the axial piston pumps. The valve body may be received in a bore in the pump housing, which may a molded in bore, a machined bore, and/or a combination thereof. As shown, in an embodiment the outlet check valve assembly may include a low mass cap and/or a consolidated cap and check valve cage. Consistent with the illustrated embodiment, each check valve assembly may be retained within the pump housing using a roll pin or similar retention feature. Such a configuration may, for example, facilitate assembly of the pump and/or repair or replacement of the outlet check valves.

Figure 19A:
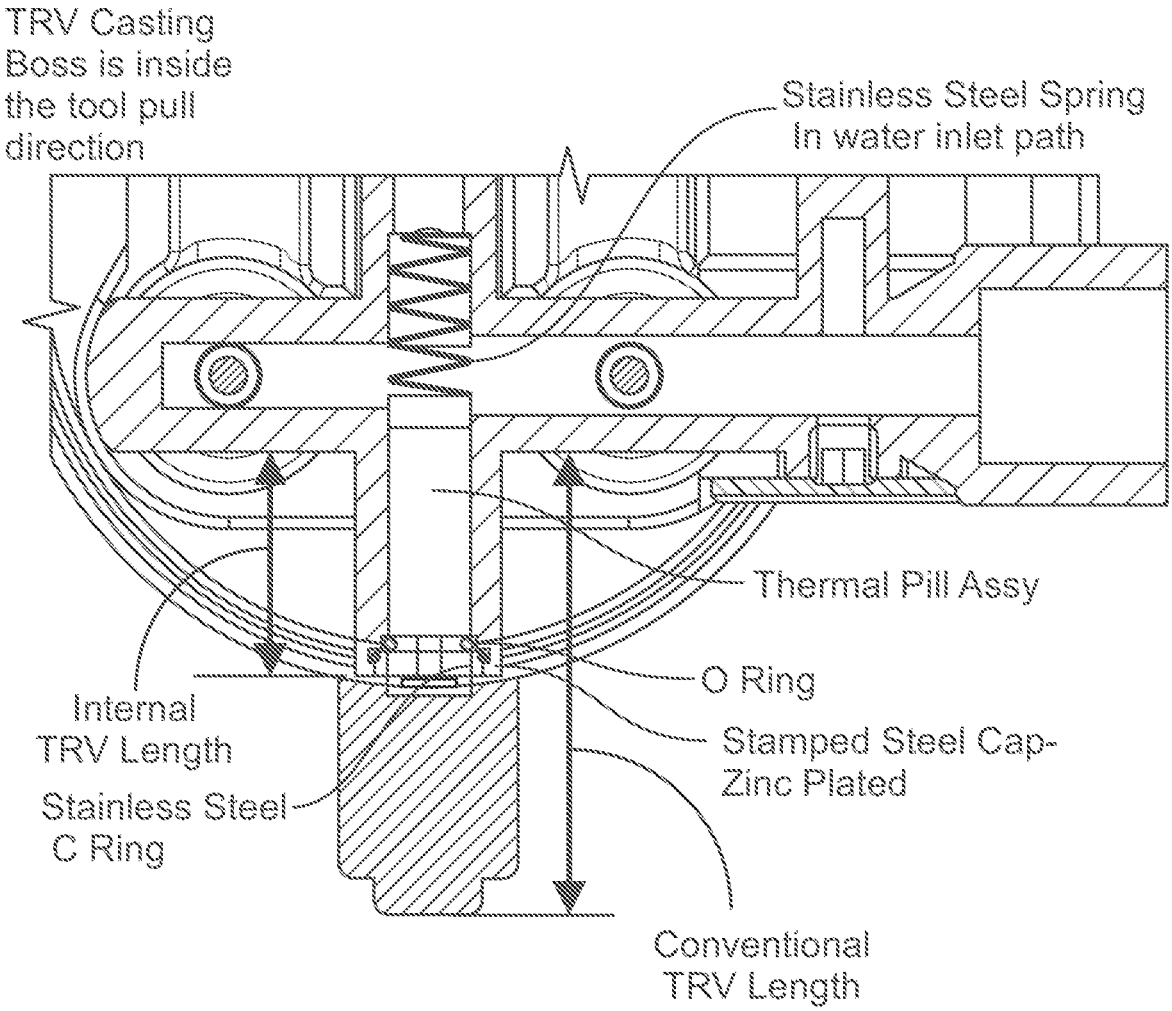
FIGS. 19A-19C diagrammatically depict features of a thermal relief valve according to illustrative example embodiments.
Figure 19B:
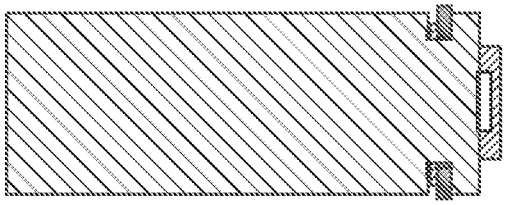
Figure 19C:
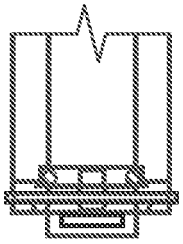

Referring to FIGS. 19A-19C, an illustrative example of a thermal relief valve assembly consistent with the present disclosure is shown. The thermal relief valve may be at least partially disposed within a bore that may be molded, machined, or a combination thereof, into the pump housing. As shown, the thermal pill assembly may be disposed within the water flow path, and may be biased by a stainless steel spring, which may be disposed within the water inlet path of the pump. The thermal pill assembly may be sealed within the bore by an O-ring, or other suitable sealing arrangement, and a cap member. Further, the thermal pill assembly and cap may be retained within the pump housing by a stainless steel C-ring or a U-shaped round or flat clip. It will be appreciated that various additional and/or alternative arrangements may also be utilized. It will be appreciated that while the thermal relief valve has been shown disposed in a cavity within the pump housing (e.g., which may be integrally molded and/or formed in the pump housing after molding as a secondary machining operation), in some implementations an external thermal relief valve may be implemented. In one such example, the pump housing may include a boss in the manifold, e.g., which may be arranged to accept an externally threaded thermal relief valve. It will be appreciated that other configurations may also be utilized. As generally shown, in an embodiment, the thermal relief valve may be substantially, if not entirely, disposed within a boss, or recess, formed within the pump housing, as contrasted with a conventional thermal relief valve that may be disposed on the exterior of, and protrude from, the pump housing, as shown in broken line. Additionally, as shown in the illustrated, an embodiment of a thermal relief valve disposed within a boss or recess of the pump housing may have a length that may be less than a length of a conventional thermal relief valve. In some implementations, the length of the thermal relief valve disposed within a boss or recess of the pump housing may have a length that is substantially less than the length of a conventional thermal relief valve.

Consistent with the present disclosure, a pump may be provided having a singular housing casting that may include integral mounts for attaching the pump relative to a prime mover or chassis, integral pump cylinders, and integral inlet and outlet manifolds. Consistent with such an embodiment, as the pump housing may include only a singular casting, the need to align and attach separate housing components may be avoided. As such, a relatively simpler assembly may be provided that may avoid manufacturing an alignment problems that may result from the use of multiple individual housing components. Additionally, the singular casting may avoid, or reduce, the number of external fasteners, which would otherwise be susceptible to environmental attack and corrosion. Further, the inclusion of at least partially molded in oil and water drains in the singular casting may simplify manufacturing, for example with respect to cross drilling operations or the like. Various additional/alternative features may also be realized through the use of a pump housing including a singular casting.

Various features and implementations of pumps consistent with the present disclosure have been illustrated and described. Various additional and/or alternative features may similarly be implemented in connection with a pump consistent with the present disclosure. For example, a pump consistent with the present disclosure may be implemented to utilize unloader systems of varying configurations and operating principles. For example, as is generally known, an unloader valve may redirect water flow from the high pressure outlet side of the pump when the spray gun valve is closed and/or the outlet is otherwise obstructed. For example, in connection with pumps utilizing a prime mover that may not automatically shut off when the demand for high pressure water is not required, the continuing operation of the positive displacement piston pump against the closed outlet (e.g., resulting from the closed spray gun valve) may place thermal and mechanical stress on the pump system and/or on the prime mover. In such a situation, the unloader system may divert the high pressure fluid from the outlet of the pump back to the inlet side of the pump and/or may otherwise direct the high pressure fluid from the outlet of the pump such that undue stress of operating the positive displacement pump against a closed outlet may be avoided and/or reduced.

Generally two varieties of unloader systems of commonly used: a trapped pressure unloader and a flow activated unloader. A trapped pressure unloader may generally include a check valve (e.g., which may be referred to as a non-return valve) that may seal "trapped" pressure between the check valve and the spray gun valve. This trapped pressure may act on a small piston in the unloader, which may cause a fluid passage to open and allow fluid to flow internally through the pump (e.g., from the high pressure outlet side to the low pressure inlet side). A flow activated unloader may generally utilize a sliding valve that may be acted on by a differential of pressure. For example, a shuttle of the sliding valve may move from one position permitting fluid to flow through the high pressure system (e.g., the pressure washer gun). When the valve of the pressure washer gun is closed (and/or the flow path is otherwise obstructed) the shuttle of the sliding valve may move to a second position redirecting the high pressure fluid through one or more internal passages in the pump (and/or otherwise direct the high pressure fluid), for example, to the low pressure inlet side of the pump. In either unloader system, when the pressure washer gun valve is closed (and/or the flow path is otherwise obstructed), the high pressure fluid may be cause to circulate from the high pressure outlet side of the pump to the low pressure inlet side of the pump (and/or otherwise be released), to reduce and/or eliminate the stress on the pump system resulting from pumping against a closed outlet.

It will be appreciated that the various types of unloader systems (and even different unloader systems of the same type) may have different physical configurations and/or may utilize different fluid pathways to achieve the desired result. Accordingly, the internal components and the features cast within, or machined into, the pump housing to accommodate the unloader systems may vary to suit different applications. Accordingly, the present disclosure should be construed as providing for such different arrangements necessary to suit a variety of unloader system configurations.

In some implementations, a pump system consistent with the present disclosure may be configured to be used in connection with an integrated chemical injection system. In general, a chemical injection system may be implemented to allow an additional agent to be mixed with the high pressure fluid and dispensed along with the high pressure fluid. Examples of some additional agents may include, but are not limited to, detergents, degreasers, cleaning solutions, etc. Often, chemical injection systems may be configured to introduce the additional agents near the high pressure outlet of the pump. For example, in some embodiments, additional agents may be introduced into the stream of high pressure fluid from the pump using a venturi (e.g., which may also be referred to as a mixing tube), which may cause the flow of the high pressure fluid to change velocity and pressure through a series of different sized orifii. Generally, in the absence of atmospheric pressure, a differential of pressures may cause the stream of high pressure fluid form the pump to cavitate as the high pressure fluid passes through the different sized chambers. A fitting may be located in fluid communication with the venturi arrangement. The fitting may include a small check valve that may open when greater fluid flow at relatively lower pressures pass through the venturi causing a vacuum that may display the check valve allowing atmospheric pressure to enter the high pressure fluid stream. The fitting may often include a barbed external feature that may secure a flexible hose to deliver the additional agents from a container into the high pressure fluid stream (e.g., during the relatively lower pressure mode created by the venturi). The additional agents introduced into the high pressure fluid stream may be, for example, delivered through a pressure washer gun to a working surface. As such, a pressure washer including a chemical injection system may allow the pressure washer to utilize cleaning agents, or other additional agents. In some embodiments, the fitting may be removed, or bypassed, to allow the high pressure fluid to be utilized without the introduction of additional agents. As noted above, in some implementations, the fitting may often be attached to the high pressure outlet of the pump, e.g., via a threaded fitting or the like. As such, the fitting may be easily removed from the, in some embodiments.

As generally discussed above, the prime mover (e.g., gasoline engine, electric motor, or the like) may be coupled to the pump to drive the rotating cam plate. In some implementations, the output shaft of the prime mover and the input of the rotating cam plate may be keyed together, e.g., to prevent and/or reduce the likelihood of the prime mover shaft rotationally slipping relative to the cam plate. In some implementations, the output shaft of the prime mover may include an axial groove, or channel, which may provide a keyseat, or pocket, to receive a key. A corresponding groove, or slot, may be provided in the cam plate to provide a keyway. The corresponding keyseat and keyway may allow a key to extend between, and to rotatably couple, the output shaft and the cam plate. In some implementations, the key may be provided as a separate component from the output shaft and from the cam plate. As such, the key may be assembled to one of the output shaft and the cam plate prior to mating the output shaft and the cam plate. In some implementations, assembling the key with the output shaft may require a process to impose a slight amount of deformation to the output shaft, e.g., to create an interference fit or friction fit between the key and the keyseat as a means to secure the key within the key seat. Such a process may, in some situations reduce the likelihood that the key may move out of position during assembly. In this regard, the efficiency and speed of assembly the prime mover to the pump may be improved. It will be appreciated that other arrangements may be provided for rotationally coupling the prime mover and the pump (e.g., including the rotating cam plate).

A variety of features of the pump have been described. However, it will be appreciated that various additional features and structures may be implemented in connection with a pump according to the present disclosure. As such, the features and attributes described herein should be construed as a limitation on the present disclosure.

What is claimed is:

1. A pump comprising:

a pump housing formed as a singular body, the pump housing comprising:

a mounting feature adjacent a first end of the pump housing, the mounting feature configured for mounting the pump relative to a prime mover;

a drive system cavity formed in the first end of the pump housing, the drive system cavity being sized to receive at least a portion of an axial drive system, the axial drive system including a cam plate configured for axially driving a pump piston when the cam plate is rotationally driven; and a pump cylinder extending inwardly into the pump housing from the drive system cavity; and a piston guide plate configured to be affixed within the drive system cavity, the piston guide plate including a piston guide associated with the pump cylinder, the piston guide including a bore configured to at least partially receive the pump piston therethrough for facilitating alignment and axial movement of the pump piston within the pump cylinder;

wherein the axial drive system at least partially seals the drive system cavity of the pump housing opposite the piston guide plate to provide an integrated oil reservoir between the axial drive system and the piston guide plate; and wherein the piston guide plate is configured to be affixed to the pump housing by one or more bolts, wherein a head of each of the one or more bolts is at least partially disposed within the integrated oil reservoir.

2. The pump according to claim 1, wherein the cam plate is at least partially disposed in the integrated oil reservoir.

3. The pump according to claim 1, wherein the piston guide including the bore extending through the piston guide plate, further includes a seal associated with the bore to mitigate fluid intrusion between the pump piston and the piston guide plate.

4. The pump according to claim 1, further including a seal disposed between at least a portion of the piston guide plate and the pump housing.

5. The pump according to claim 4, wherein the seal includes an O-ring disposed in a groove around a periphery of the piston guide plate.

6. The pump according to claim 1, further comprising one or more fluid passages formed between the pump housing and the piston guide plate, the one or more fluid passages providing a fluid pathway between the piston guide and a fluid intake of the pump cylinder.

7. The pump according to claim 6, wherein the fluid passage includes a channel formed on a surface of the piston guide plate, the channel configured to be substantially enclosed by the pump housing when the piston guide plate is assembled with the pump housing.

8. The pump according to claim 1, wherein the pump housing includes an at least partially integrally formed low pressure intake manifold associated with the pump cylinder.

9. The pump according to claim 1, wherein the pump housing includes an at least partially integrally formed high pressure outlet manifold associated with the pump cylinder.

10. A pump comprising:

a pump housing formed as a singular body, the pump housing comprising:

a mounting feature adjacent a first end of the pump housing, the mounting feature configured for mounting the pump relative to a prime mover;

a drive system cavity formed in the first end of the pump housing, the drive system cavity being sized to receive at least a portion of an axial drive system, the axial drive system including a cam plate; and a plurality of pump cylinders extending inwardly into the pump housing from the drive system cavity;

a plurality of pump pistons, a respective one of the plurality of pump pistons reciprocatingly received in a respective one of the plurality of pump cylinders, the cam plate being configured for axially driving the plurality of pump pistons when the cam plate is rotationally driven; and a piston guide plate configured to be affixed within the drive system cavity, the piston guide plate including a respective piston guide associated with each of the plurality of pump cylinders, each piston guide including a bore configured to at least partially receive a respective pump piston therethrough for facilitating alignment and axial movement of the respective pump piston within the respective pump cylinder, wherein the piston guide plate includes one or more channels formed on a surface of the piston guide plate, the one or more channels defining fluid passages at least partially surrounding each respective piston guide, and providing a fluid pathway between each respective piston guide and one or more of a fluid intake of the pump and a drain.

11. The pump according to claim 10, wherein the axial drive system at least partially seals the drive system cavity of the pump housing opposite the piston guide plate to provide an integrated oil reservoir between the axial drive system and the piston guide plate.

12. The pump according to claim 11, wherein the piston guide plate is configured to be affixed to the pump housing by one or more bolts, wherein a head of each of the one or more bolts is at least partially disposed within the integrated oil reservoir.

13. The pump according to claim 12, further comprising a seal disposed between the pump housing and the piston guide plate at least partially surrounding each of the one or more bolts.

14. The pump according to claim 10, wherein the one or more channels are at least partially enclosed by the pump housing when the piston guide plate is assembled with the pump housing.

15. The pump according to claim 10, wherein the pump housing includes an at least partially integrally formed low pressure intake manifold associated with the plurality of pump cylinders.

16. The pump according to claim 10, wherein the pump housing include an at least partially integrally formed high pressure outlet manifold associated with the plurality of pump cylinders.

17. A pump comprising:

a pump housing formed as a singular body, the pump housing comprising:

a mounting feature adjacent a first end of the pump housing, the mounting feature configured for mounting the pump relative to a prime mover;

a drive system cavity formed in the first end of the pump housing;

a plurality of pump cylinders extending inwardly into the pump housing from the drive system cavity;

an at least partially integrally formed low pressure intake manifold associated with the plurality of pump cylinders; and an at least partially integrally formed high pressure outlet manifold associated with the plurality of pump cylinders;

a plurality of pump pistons, a respective one of the plurality of pump pistons reciprocatingly received in a respective one of the plurality of pump cylinders;

a piston guide plate configured to be affixed within the drive system cavity and sealingly engaged with the pump housing by an O-ring disposed in a groove around a periphery of the piston guide plate, the piston guide plate including a respective piston guide associated with each of the plurality of pump cylinders, each piston guide including a bore configured to at least partially receive a respective pump piston therethrough for facilitating alignment and axial movement of the respective pump piston within the respective pump cylinder; and an axial drive system at least partially disposed within the drive system cavity, the axial drive system including a cam plate configured for axially driving the plurality of pump pistons when the cam plate is rotationally driven, providing an integral oil reservoir within the drive system cavity between the axial drive system and the piston guide plate.

* * * * *